US008843220B1

(12) United States Patent
Rembach et al.

(10) Patent No.: US 8,843,220 B1
(45) Date of Patent: Sep. 23, 2014

(54) POSITION AND VELOCITY MEASUREMENT TOOL FOR STANDARD AND DIRECTIONAL DRILLING

(71) Applicants: Paul F. Rembach, Houston, TX (US); Reiner Fiege, Humble, TX (US)

(72) Inventors: Paul F. Rembach, Houston, TX (US); Reiner Fiege, Humble, TX (US)

( * ) Notice: Subject to any disclaimer, the term of this patent is extended or adjusted under 35 U.S.C. 154(b) by 0 days.

(21) Appl. No.: 14/106,616

(22) Filed: Dec. 13, 2013

(51) Int. Cl.

| | |
|---|---|
| ***G05B 19/18*** | (2006.01) |
| ***E21B 44/00*** | (2006.01) |
| ***E21B 3/06*** | (2006.01) |
| ***E21B 19/08*** | (2006.01) |
| ***E21B 47/00*** | (2012.01) |
| ***E21B 47/18*** | (2012.01) |
| ***E21B 25/16*** | (2006.01) |
| ***E21B 47/02*** | (2006.01) |
| ***E21B 7/04*** | (2006.01) |

(52) U.S. Cl.
CPC .. *E21B 44/00* (2013.01); *E21B 7/04* (2013.01)
USPC ..... 700/56; 175/26; 175/27; 175/40; 175/45; 175/61; 175/73

(58) Field of Classification Search
USPC ..... 700/56; 175/26, 27, 40, 45, 61, 73
See application file for complete search history.

(56) References Cited

U.S. PATENT DOCUMENTS

| | | | | |
|---|---|---|---|---|
| 4,793,421 | A * | 12/1988 | Jasinski | 175/27 |
| 6,918,453 | B2 * | 7/2005 | Haci et al. | 175/26 |
| 7,461,705 | B2 * | 12/2008 | Hulick et al. | 175/24 |
| 8,360,171 | B2 * | 1/2013 | Boone et al. | 175/26 |
| 2002/0104685 | A1 * | 8/2002 | Pinckard et al. | 175/61 |
| 2008/0156531 | A1 * | 7/2008 | Boone et al. | 175/27 |
| 2009/0078462 | A1 * | 3/2009 | Boone et al. | 175/26 |

* cited by examiner

*Primary Examiner* — Mohammad Ali
*Assistant Examiner* — Ziaul Karim
(74) *Attorney, Agent, or Firm* — Buskop Law Group, PC; Wendy Buskop

(57) ABSTRACT

A position and velocity measuring tool for use on a top drive of a drilling rig having a variable frequency drive connected to an electric motor and power supply. The position and velocity measuring tool further has a processor connected to the variable frequency drive and a data storage and computer instructions for presenting an operator directional drilling steering system dashboard with numerous visual components which creates and uses a virtual encoder eliminating a failure point of a mechanical encoder.

7 Claims, 4 Drawing Sheets

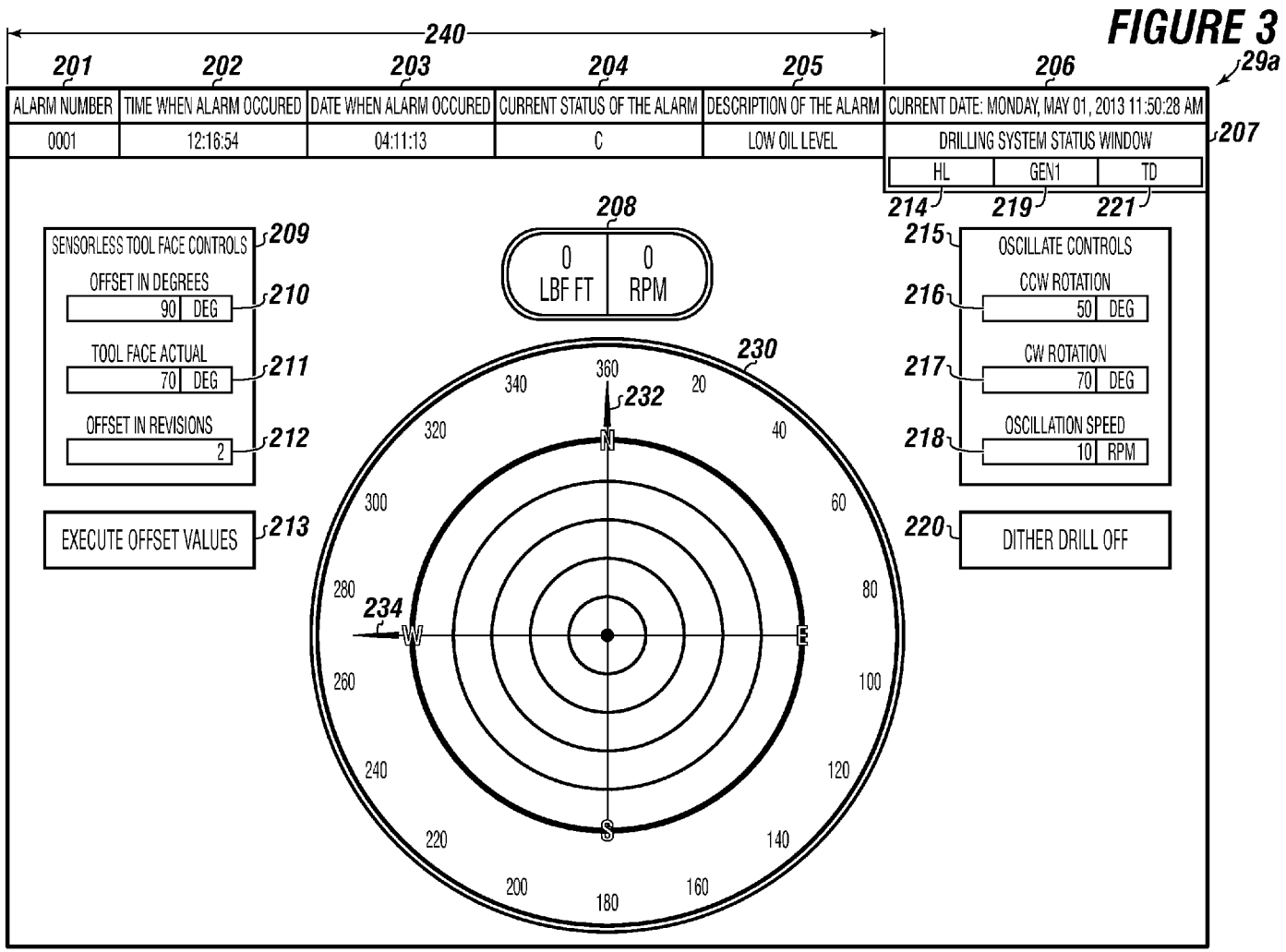
FIGURE 3
29a
240
201
202
203
204
205
206
207
ALARM NUMBER
TIME WHEN ALARM OCCURED
DATE WHEN ALARM OCCURED
CURRENT STATUS OF THE ALARM
DESCRIPTION OF THE ALARM
CURRENT DATE: MONDAY, MAY 01, 2013 11:50:28 AM
0001
12:16:54
04:11:13
C
LOW OIL LEVEL
DRILLING SYSTEM STATUS WINDOW
HL
GEN1
TD
214
219
221
208
0 LBF FT
0 RPM
230
232
234
N
E
S
W
360
20
40
60
80
100
120
140
160
180
200
220
240
260
280
300
320
340
SENSORLESS TOOL FACE CONTROLS
209
OFFSET IN DEGREES
210
90
DEG
TOOL FACE ACTUAL
211
70
DEG
OFFSET IN REVISIONS
212
2
EXECUTE OFFSET VALUES
213
OSCILLATE CONTROLS
215
CCW ROTATION
216
50
DEG
CW ROTATION
217
70
DEG
OSCILLATION SPEED
218
10
RPM
DITHER DRILL OFF
220

POSITION AND VELOCITY MEASUREMENT TOOL FOR STANDARD AND DIRECTIONAL DRILLING

FIELD

The present embodiments generally relate to a position and velocity measuring tool usable for standard drilling and directional drilling in a wellbore.

BACKGROUND

A need exists for a sensorless, physical encoderless ability to drill in a wellbore for improved reliability.

A need exists for a top drive with a virtual encoder.

The present embodiments meet these needs.

BRIEF DESCRIPTION OF THE DRAWINGS

The detailed description will be better understood in conjunction with the accompanying drawings as follows:

FIG. 3 depicts an operator directional drilling steering system dashboard.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments generally relate to a position and velocity measuring tool usable for standard drilling and directional drilling in a wellbore using a drilling rig with a top drive.

The embodiments further relate to and apparatus to increase reliability of top drives and ensuring continuous operation.

A benefit of the position and velocity measuring tool is that it eliminates top drive runaway that is caused by loss of encoder feedback on the top drive. Top drive runaway causes drill pipes to break and fall, which can cause injuries to workers.

Another benefit of the position and velocity measuring tool is that it eliminates the need for hardware encoder feedback, which eliminates the need for torque pulsing of the drill pipe from a partially failed encoder, which could shake drill pipe uncontrollably resulting in the shaking of the rig floor causing workers to fall down and injure themselves in the event that a make-up or break-out pipe tong is connected.

A further benefit of the position and velocity measuring tool is that it enables the drilling for fossil fuels more reliability using software that does not breakdown in place of hardware that breaks down, enabling more wells to be drilled at lower costs.

Yet another benefit of the position and velocity measuring tool is that it prevents fires on a drill rig, because the position and velocity measuring tool provides a more reliable method of drilling, with fewer breakdowns. Breakdowns often lead to fires and explosions, resulting in serious bodily injury and even death of personnel.

A further benefit of the invention is that the invention reduces failure points in the drill string through the elimination of torque pulses caused by the failure of encoder feedback. The elimination of torque pulses caused by the failure of encoder feedback significantly increases the reliability of the top drive, resulting in the potential savings of millions of dollars that would be lost in downtime, as well as potential loss of life.

Figure 1:
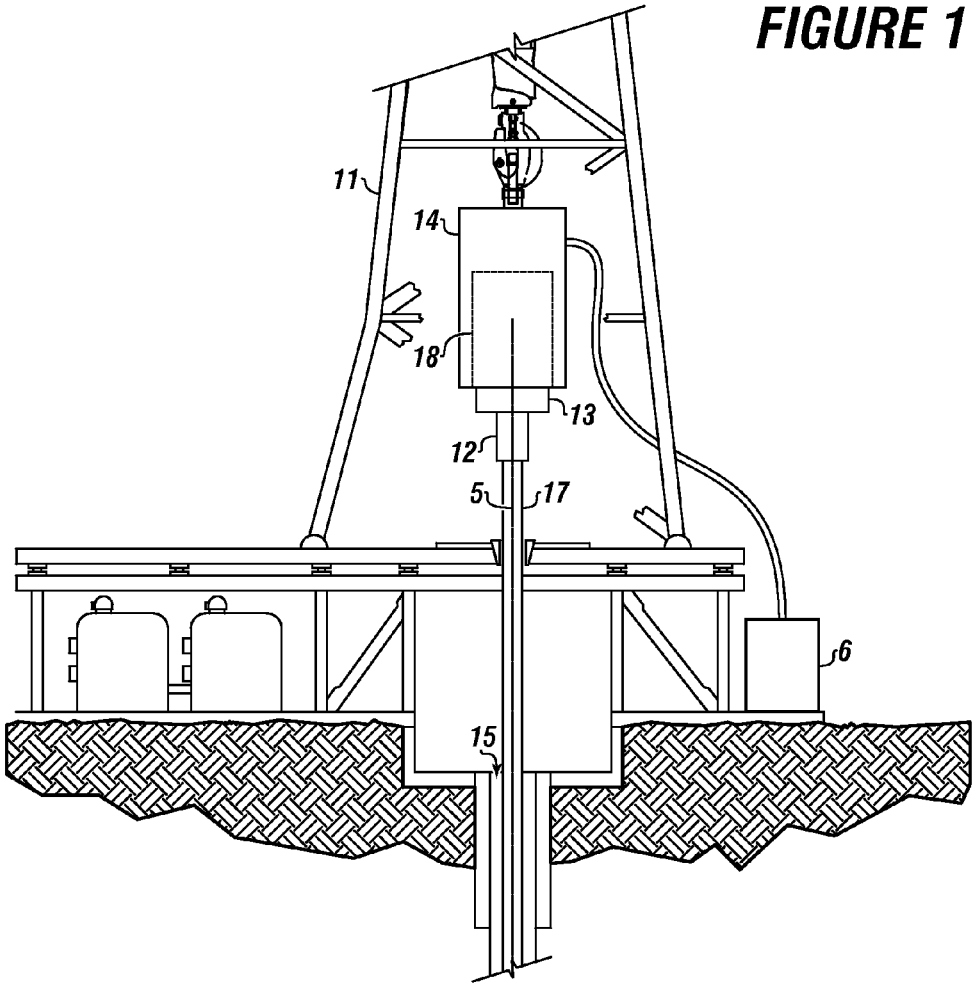
FIG. 1 depicts a drilling rig with the position and velocity measuring tool mounted proximate to and in communication with the top drive.

Turning now to the Figures, FIG. 1 depicts a drilling rig with the position and velocity measuring tool mounted to the top drive.

The drilling rig 11 can be an oil and natural gas drilling rig. The drilling rig can support a top drive 14 for installing drill pipe 17 in a wellbore 15. The top drive can be a moveable top drive.

The top drive 14 can communicate with the position and velocity measuring tool 6.

The position and velocity measuring tool 6, in part, can connect to an electric motor 18 in the top drive. The electric motor 18 can connect to a gear 13.

The gear 13 can rotate the quill 12 that engages the drill pipe as the drill pipe is run into the wellbore 15.

The quill 12 can have a central axis 5 which parallels the wellbore.

Figure 2:
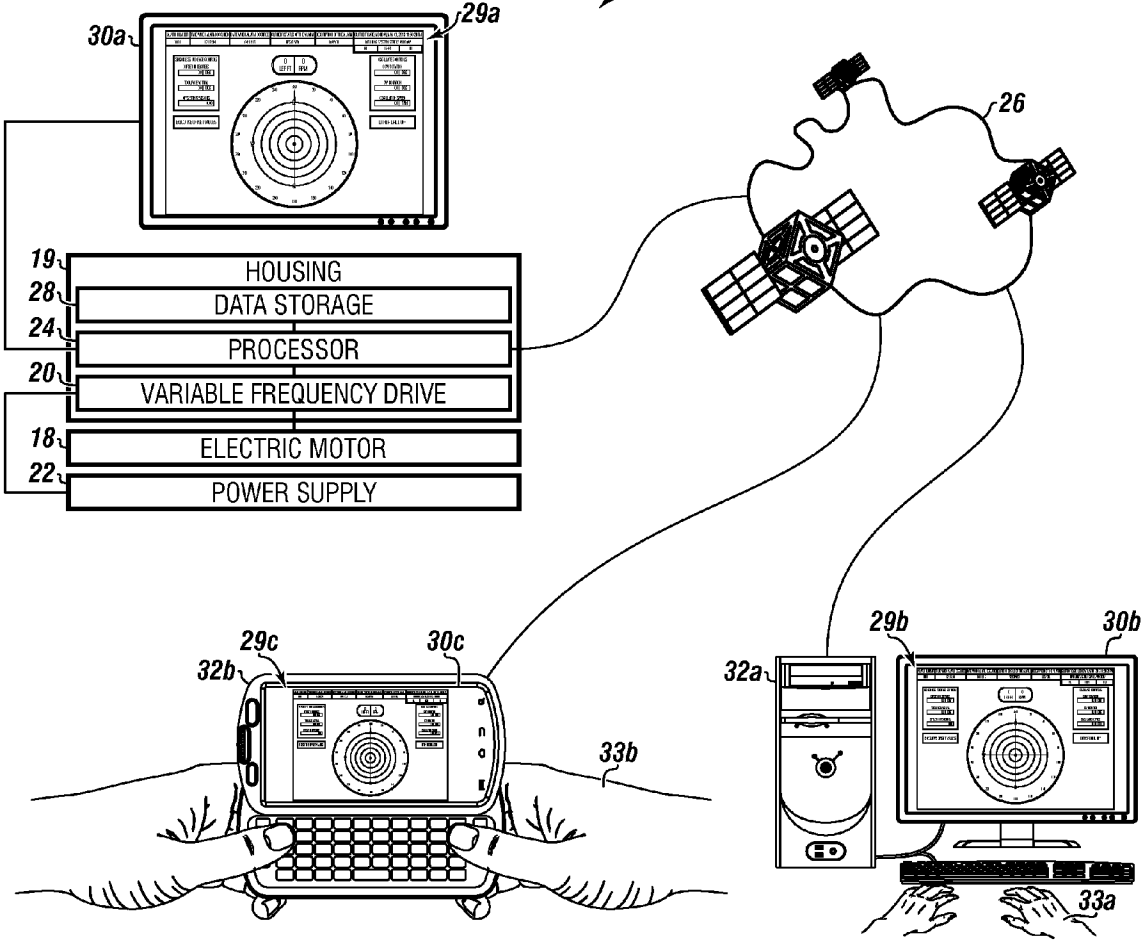
FIG. 2 depicts a detail of the position and velocity measuring tool.

FIG. 2 shows a detail of the position and velocity measuring tool.

The position and velocity measuring tool 6 can include a housing 19 and the computer instructions in a data storage 28 in the housing to produce an operator directional drilling steering system dashboard viewable on client devices and other displays.

The position and velocity measuring tool 6 can have a variable frequency drive 20 that can communicate with and have an electrical connection to a processor 24 which can communicate to the data storage 28.

The variable frequency drive 20 can connect to a power supply 22 that can supply power to the drilling rig.

The variable frequency drive can connect to the electric motor 18 in the top drive.

The processor 24 of the position and velocity measuring tool 6 can communicate to a display 30*a* which can be remote from the top drive.

The display 30*a* can be connected directly or wirelessly to the processor 24 through a network 26.

The display 30*a* can present an operator directional drilling steering system dashboard 29*a* that can be formed using computer instructions in the data storage 28.

Client devices 32*a* and 32*b* can communicate with the network 26 and have displays 30*b* and 30*c*. Each display can present the same operator directional drilling steering system dashboard 29*b* and 29*c* when pushed to them from the processor.

The operator directional drilling steering system dashboards 29*b* and 29*c* can be shown on the displays 30*b* and 30*c* of the client devices 32*a* and 32*b*.

The processor 24 can be a computer or a programmable logic controller. The processor 24 can be a plurality of processors connected together, such as a cloud based processing system.

In embodiments, the data storage 28 can be remote to the housing 19 for communication through a network 26.

The network 26 can be a satellite network, the internet, a cellular network, a local area network, another global communication network, a wide area network or several of these networks connected together.

The client devices 32*a* and 32*b* can be cell phones, laptops, other computers, tablets, or personal digital assistants each with a processor and data storage and ability to connect to a network.

In embodiments, a client device can simply display the alarm portion of the operator directional drilling steering system dashboard enabling executives that are remote to a drilling site to more closely monitor the drilling and take steps to prevent a blow out or possible explosion when the quill deviates too much from the desired orientation.

Remote users 33*a* and 33*b* can operate the client devices.

FIG. 3 shows the operator directional drilling steering system dashboard with various dynamic features.

The operator directional drilling steering system dashboard 29*a* can depict alarm information 240 including an alarm number 201. The alarm number is identified as "0001".

Alarm information 240 can include a time when alarm occurred 202, which is shown as 12:16:54 using a 24 hour military clock designation.

Alarm information 240 can include a date when alarm occurred 203, shown as month, day and year: 04:11:13.

Alarm information 240 can include a current status of the alarm 204, which is indicated as "C" when the alarm comes in with the message. Later, when the same alarm is resolved, the code "CD" can be displayed.

The letter "C" represents that the alarm is coming, which is an industry standard in alarm logic from Europe, particularly in Germany as "kommt" and "geht." Alarms come and go, so the letters relate to coming and going.

The letter "D" represents that the alarm has disappeared. If the letter "D" is used, then the alarm is generally resolved.

Alarm information 240 can include a description of the alarm 205, such as "low oil level" for pump 001. The description can also refer to low oil pressure or other descriptions.

The operator directional drilling steering system dashboard 29*a* can depict a current date 206 for the moment in time that the operator is viewing the operator directional drilling steering system dashboard. The current date can show in embodiments, as a day of the week, a month, a year, an hour, with minutes and seconds. The current date is shown as Monday, May 1, 2013 at 11:50:28 AM.

The operator directional drilling steering system dashboard 29*a* can depict a drilling system status window 207 with at least 3 indicators showing power generation and status of the drilling equipment.

High line (HL) 214 represents high line which is power from a power grid. Generator one (Gen1) 219 represents generator 1. Top drive (TD) 221 represents the top drive. Each indicator can be illuminated when power is provided or the device is running.

The operator directional drilling steering system dashboard 229*a* can depict a drill string meter 208. The drill string meter can show revolutions per minute of the quill, shown as 0 rpm, and torque in foot-pounds on the quill, shown as 0 lbf ft.

The position and velocity measuring tool can measure revolutions per minute and torque of the top drive, which can be up to 400 rpm and up to 50,000 foot-pounds respectively, which can be provided as a feedback communication from the variable frequency drive to the processor and into the data storage. Typical settings for a small top drive can be lower than settings for a larger top drive.

The operator directional drilling steering system dashboard 29*a* can depict sensorless tool face controls 209 which display and enable modification of orientations of the quill connected to the drill string. The position and velocity measuring tool provides a virtual encoder replacing the need for an actual encoder for the top drive.

The operator directional drilling steering system dashboard 29*a* can depict offset in degrees 210 which is a set value on how much an operator wants to turn a quill.

The operator directional drilling steering system dashboard 29*a* can depict a tool face actual degree orientation 211.

Due to the elasticity of the drill string, a rotation in degrees, such as 90 degrees at the quill, does not equal the rotation of the tool face in the wellbore.

For example, the tool face can only rotate 10 degrees in the wellbore with a 90 degree rotation of the quill at the top drive.

The tool face actual orientation can be entered into the tool face actual degree orientation 211 to correct for downhole resistance and the elasticity of the drill pipe.

The offset in degrees is shown as 90 degrees and the tool face actual degree orientation is shown as 70 degrees.

The operator directional drilling steering system dashboard 29*a* can depict an offset in revision 212. The offset in revision can indicate an offset in degrees plus at least one complete 360 degree rotation of the drill string. The offset in revision indicates 720 degrees of rotation, which is 360 times 2. The offset in revisions 212 represents a quantity of 360 degree rotations around the axis of the quill.

The sensorless tool face controls can have an execute offset values activation button 213 to activate computer instructions to instruct the processor to operate the electric motor to rotate the quill to the degrees input to the sensorless tool face controls. The execute offset values activation button 213 can execute the offset in degrees, the tool face actual degree orientation 211 and the offset in revisions 212 of the sensorless tool face controls 209.

The operator directional drilling steering system dashboard 29*a* can depict sensorless oscillate controls 215 which can display and enable changing of an amount of rotation of the quill to rock the drill string while drilling within the formation. The sensorless oscillate controls can include counterclockwise rotation in degrees 216, clockwise rotation in degrees 217, and oscillation speed 218.

Counterclockwise rotation in degrees 216 can be an amount of degrees in a counterclockwise rotation the quill imparts to the drill string. The drill string can rotate counterclockwise to enable a dithering action of the drill string between clockwise and counterclockwise rotation. The counterclockwise rotation in degrees is shown as 50 degrees, which indicates a counterclockwise rotation of the quill from a stationary point to a degree orientation 50 degrees from that point. The stationary point can be the tool face actual degree orientation 211.

Clockwise rotation in degrees 217 can be an amount of degrees in a clockwise rotation which the quill imparts to the drill string. The clockwise rotation in degrees is shown as 70 degrees, which indicates a clockwise rotation from the stationary point to a degree orientation 70 degrees from that point. The stationary point can be the tool face actual degree orientation 211.

Oscillation speed 218 can be a value of revolutions per minute the quill is to impart to the drill string to achieve the rocking while drilling within the formation desired by the operator. The oscillation speed is shown as 10 rpm indicating a rotation of the quill.

The operator directional drilling steering system dashboard 29*a* can have a dither drill on/off button 220, which can be connected to computer instructions to instruct the processor to start or stop the electric motor to rotate the quill to the degrees input to the sensorless oscillate controls. The text of the dither drill on/off button 220 can change to indicate the operating drill status. In an embodiment, the dither drill on/off button can be configured to display two buttons, one for off and one for on.

The operator directional drilling steering system dashboard 29*a* can have a quill pointer 232, which can point to a degree number that indicates the current rotation of the quill.

The operator directional drilling steering system dashboard 29*a* can have a tool face pointer 234, which can point to a degree number that indicates the current position of the tool face. The tool face pointer 234 can be formed on a wellbore map 230 indicating rotation of the tool face.

Information from the tool face can occur every few seconds. Dots can be placed on the target to show where the tool face is located. The update time is variable depending upon the depth of the tool face within the well.

Computer instructions can colorize the operational condition to be green for normal operation, yellow for warning that a non-fatal fault is occurring in the operating system and red for a critical warning that the top drive has shut down to preserve the tool.

Figure 4:
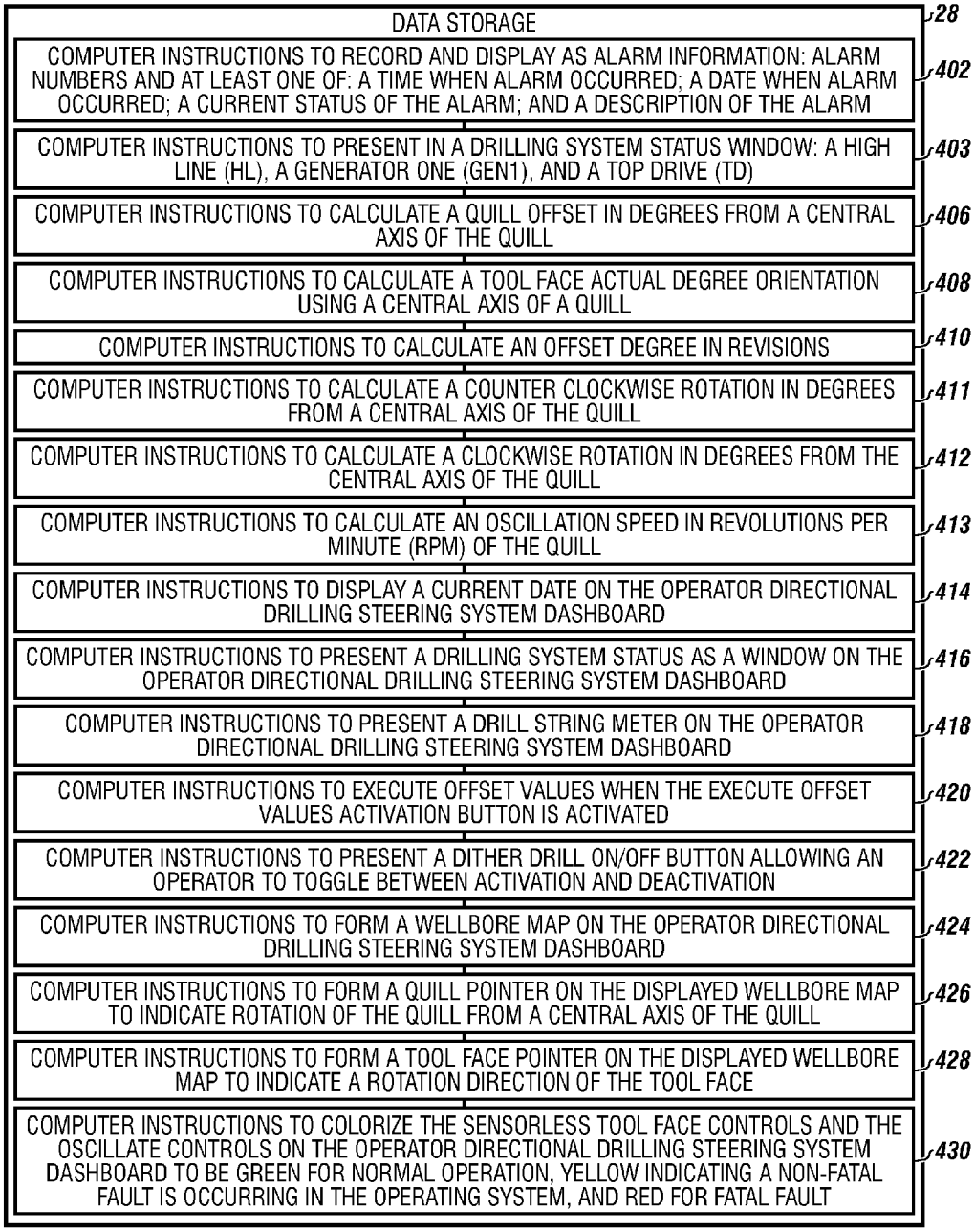
FIG. 4 depicts a diagram of the data storage of the position and velocity measuring tool.

FIG. 4 is a diagram of the data storage containing the computer instructions to create the operator directional drilling steering system dashboard.

The data storage 28 can have computer instructions 402 to record and display as alarm information: alarm numbers and at least one of: a time when alarm occurred; a date when alarm occurred; a current status of the alarm; and a description of the alarm.

The data storage 28 can have computer instructions 403 to present in a drilling system status window: a high line (HL), a generator one (GEN1), and a top drive (TD). For operation, two of the windows should always be on, or colored green. The two windows that should always be on will either be the combination of the top drive and high line, or top drive and generator one.

The data storage 28 can have computer instructions 406 to calculate a quill offset in degrees from a central axis of the quill.

The data storage 28 can have computer instructions 408 to calculate a tool face actual degree orientation using a central axis of a quill.

The data storage 28 can have computer instructions 410 to calculate an offset degree in revisions.

The data storage 28 can have computer instructions 411 to calculate a counter clockwise rotation in degrees from a central axis of the quill.

The data storage 28 can have computer instructions 412 to calculate a clockwise rotation in degrees from the central axis of the quill.

The data storage 28 can have computer instructions 413 to calculate an oscillation speed in revolutions per minute of the quill.

The data storage 28 can have computer instructions 414 to display a current date on the operator directional drilling steering system dashboard.

The data storage 28 can have computer instructions 416 to present a drilling system status as a window on the operator directional drilling steering system dashboard.

The data storage 28 can have computer instructions 418 to present a drill string meter on the operator directional drilling steering system dashboard.

The data storage 28 can have computer instructions 420 to execute offset values when the execute offset values activation button is activated.

The data storage 28 can have computer instructions 422 to present a dither drill on/off button allowing an operator to toggle between activation and deactivation.

The data storage 28 can have computer instructions 424 to form a wellbore map on the operator directional drilling steering system dashboard.

The data storage 28 can have computer instructions 426 to form a quill pointer on the displayed wellbore map to indicate rotation of the quill from a central axis of the quill.

The data storage 28 can have computer instructions 428 to form a tool face pointer on the displayed wellbore map to indicate a rotation direction of the tool face.

The data storage 28 can have computer instructions 430 to colorize the sensorless tool face controls and the sensorless oscillate controls on the operator directional drilling steering system dashboard to be green for normal operation, yellow indicating a non-fatal fault is occurring in the operating system, and red for fatal fault. For example, red can be a critical warning that the top drive has shut down to preserve the tool.

In embodiments, the position and velocity measuring tool can be a drill bit, directional drilling tools, tools associated with downhole assemblies, fishing tools, a casing hanger, a swell packer, a packer assembly, or combinations thereof.

To use the embodiments to steer a quill, the operator can log into the system with a user name and password.

Next, the operator can select the operator directional drilling steering system dashboard to be displayed.

The display can be connected to a processor and data storage which can communicate to a variable frequency drive for operating an electric motor connected to a gear box mounted on the top drive.

The operator can see alarm information and a current date on the display.

If an alarm is indicated in the alarm information, the operator can investigate the cause of the alarm or notify another worker to investigate.

The alarm information allows the operator to check the time, date, status and description of each alarm in the alarm information section. Multiple alarms with multiple statuses can be viewed simultaneously by the operator and by users of client devices connected to the network and the processor.

The operator can next check the operational status of the top drive by looking at the drilling system status window. The drilling system status window can show that power is available or not available and that the top drive is ready to run or stopped.

Next, the operator can check the sensorless tool face controls. The operator can reset the position of the sensorless tool face in the wellbore by inputting different numbers into the sensorless tool face controls changing the offset in degrees and the offset in revisions, which results in a change to the tool face actual degree orientation.

For example, if the operator wants to reset a tool face actual degree orientation by 3 degrees, the operator can recognize that the drill string has torque applied against it. The operator can then reduce torque by applying 2 offset revisions, spinning the drill pipe two revolutions, 720 degrees, to reduce the torque.

Simultaneously with that spinning, the operator can additionally use an input of 10 degrees for offset in degrees to result in a 3 degree turn in the tool face actual degree orientation for a total of 730 degrees.

The reason for doing this is to account for the elasticity of the drill pipe.

When the operator presses the execute offset values activation button, both variables are inputted to the processor simultaneously, and the quill is moved by the gear and electric motor causing the tool face actual degree orientation to change by 3 degrees.

Once the execute offset values activation button is pressed, the quill pointer can be examined to indicate the quill moved 730 degrees, two complete revolutions plus the degrees, and verify that the tool face pointer moved the necessary 3 degrees.

An operator can make these changes using the sensorless tool face controls to obtain a better rate of penetration, such as faster rate of penetration through the rock being drilled.

Next, the operator can check the sensorless oscillate controls. The operator can reset the counterclockwise rotation in degrees, the clockwise rotation in degrees and oscillation speed.

For example, the operator can understand that the formation into which the drill bit is being drilled is about to encounter a granite boulder. A dithering motion of the drill bit can optimize fragmentation and penetration through the granite boulder. The operator can change the counterclockwise rotation in degrees to 50 degrees and the clockwise rotation in degrees to 70 degrees and increase the oscillation speed by 10 rpm to cause the drill to penetrate the granite boulder faster and without breaking the drill bit.

An operator can make changes to the sensorless oscillate controls to optimize drilling penetration through challenging rock or through soft shale.

An operator can view the drill string meter if the top drive is running, which reveals revolutions per minute of the quill and torque in foot-pounds on the quill to see if the drill string is safely turning. The drill string meter can be used with or without oscillation.

The embodiments can control both toque and sliding of the tool face in a wellbore.

The operator can activate the dither drill on/off button to either turn on or turn off the dither drill control of the top drive. The dither drill control controls the oscillation of the tool face while drilling.

The operator can view a wellbore map with a quill pointer that indicates rotation of the quill and a tool face pointer that indicates rotation of the tool face.

When the tool face pointer overlaps the quill pointer, the operator knows that the tool face and quill are at the same position. Typically the quill and tool face are not at the same position, because there is deflection in the tubulars of the drill string.

While the system is running and oscillating, the embodiments do not require the shut off of the quill to remove torque from the drill string and does not require shut off of the top drive to re-orient the drill string while the quill is off.

Turning off the quill costs the drilling operator time and money with no return on investment. Drilling stops when the quill is motionless.

The embodiments enable adjustment of the tool face while continuing to oscillate the drill string with the quill.

While these embodiments have been described with emphasis on the embodiments, it should be understood that within the scope of the appended claims, the embodiments

What is claimed is:

1. A position and velocity measuring tool for standard drilling and directional drilling of a wellbore controlling a top drive mounted to a drilling rig, wherein the top drive is connected to drill pipe using a quill with a central axis and the quill is operable by the top drive without use of an encoder and without use of sensors on the drill pipe to orient the drill pipe in the wellbore, the top drive further comprising: an electric motor, a gear connected to the electric motor and the quill, the quill for connecting to rotating drill pipe, the position and velocity measuring tool comprising:

a. a housing located in proximity to the top drive of the drilling rig;

b. a variable frequency drive mounted in the housing and connected to the electric motor and a power supply of the drilling rig;

c. a processor in the housing further in communication with and electrically connected to the variable frequency drive and a network;

d. a display connected to the processor for presenting an operator directional drilling steering system dashboard for steering drill pipe by degrees and by revolutions per minute simultaneously;

e. the operator directional drilling steering system dashboard comprising:

(i) alarm information;

(ii) a current date;

(iii) a drilling system status window;

(iv) a drill string meter displaying revolutions per minute of the quill and torque in foot-pounds on the quill;

(v) tool face controls comprising:

1. an offset in degrees from the axis of the quill;

2. a tool face actual degree orientation from the central axis of the quill; and 3. an offset in revisions, which represents a quantity of 360 degree rotations around the central axis of the quill;

(vi) an execute offset values activation button, which executes the offset in degrees, the tool face actual degree orientation and the offset in revisions of the tool face controls;

(vii) oscillate controls comprising:

1. a counterclockwise rotation in degrees around the central axis of the quill;

2. a clockwise rotation in degrees around the central axis of the quill; and 3. an oscillation speed in revolutions per minute around the central axis of the quill;

(viii) a dither drill on/off button, wherein the dither drill on/off button toggles between an activation status and a deactivation status;

(ix) a wellbore map;

(x) a quill pointer formed on the wellbore map indicating rotation of the quill; and (xi) a tool face pointer formed on the wellbore map indicating rotation of the tool face; and f. a data storage in the housing, wherein the data storage is in communication with the processor, the data storage comprising computer instructions instructing the processor to:

(i) present alarm information;

(ii) calculate a quill offset in degrees from the central axis of the quill;

(iii) calculate the tool face actual degree orientation using the central axis of the quill;

(iv) calculate an offset degree in revisions;

(v) calculate the counterclockwise rotation in degrees from the central axis of the quill;

(vi) calculate the clockwise rotation in degrees from the central axis of the quill;

(vii) calculate the oscillation speed in revolutions per minute of the quill;

(viii) display a current date on the operator directional drilling steering system dashboard;

(ix) present a drilling system status as a window on the operator directional drilling steering system dashboard;

(x) present the drill string meter on the operator directional drilling steering system dashboard;

(xi) execute offset values when the execute offset values activation button is activated;

(xii) present the dither drill on/off button allowing an operator to toggle between activation and deactivation;

(xiii) form the wellbore map on the operator directional drilling steering system dashboard;

(xiv) form the quill pointer on the displayed wellbore map to indicate rotation of the quill from the central axis of the quill; and (xv) form the tool face pointer on the displayed wellbore map to indicate a rotation direction of the tool face, wherein the position and velocity measuring tool controls the quill without use of an encoder and without use of sensors.

2. The position and velocity measuring tool of claim 1, wherein the data storage further comprises computer instructions instructing the processor to record and display as alarm information: alarm numbers and at least one of:

g. a time when alarm occurred;

h. a date when alarm occurred;

i. a current status of the alarm; and j. a description of the alarm.

3. The position and velocity measuring tool of claim 1, wherein the data storage further comprises computer instructions instructing the processor to present in a drilling system status window: a high line (HL), a generator one (GEN1), and a top drive (TD).

4. The position and velocity measuring tool of claim 1, further comprising at least one client device connected to the network and the processor, wherein the at least one client device visually displays the operator directional drilling steering system dashboard to a remote user.

5. The position and velocity measuring tool of claim 1, wherein the data storage further comprises computer instructions instructing the processor to colorize the tool face controls and the oscillate controls on the operator directional drilling steering system dashboard to be green for a normal operation, yellow indicating a non-fatal fault is occurring in the operating system, and red for a fatal fault.

6. The position and velocity measuring tool of claim 1, wherein the position and velocity measuring tool is usable with at least one of: a drill bit, directional drilling tools, tools associated with downhole assemblies, fishing tools, a casing hanger, a swell packer, and a packer assembly.

7. The position and velocity measuring tool of claim 1, wherein the dither drill on/off button shows the activation status on the dither drill on/off button.

* * * * *